US011009194B2

(12) United States Patent
Feng

(10) Patent No.: US 11,009,194 B2
(45) Date of Patent: May 18, 2021

(54) CANDLE FLAME PIECE FLICKERING DEVICE

(71) Applicant: Weiyue Feng, Ningbo (CN)

(72) Inventor: Weiyue Feng, Ningbo (CN)

( * ) Notice: Subject to any disclaimer, the term of this patent is extended or adjusted under 35 U.S.C. 154(b) by 0 days.

(21) Appl. No.: 16/744,158

(22) Filed: Jan. 15, 2020

(65) Prior Publication Data

US 2020/0149693 A1 May 14, 2020

Related U.S. Application Data

(63) Continuation of application No. PCT/CN2018/000345, filed on Sep. 29, 2018.

(30) Foreign Application Priority Data

Sep. 30, 2017 (CN) ..... 201721330024.9

(51) Int. Cl.
*F21S 6/00* (2006.01)
*F21S 10/04* (2006.01)
*F21V 23/00* (2015.01)

(52) U.S. Cl.
CPC ..... *F21S 6/001* (2013.01); *F21S 10/04* (2013.01); *F21V 23/004* (2013.01)

(58) Field of Classification Search
CPC ..... F21S 10/04; F21S 10/046; F21S 6/001; F21W 2121/00
See application file for complete search history.

(56) References Cited

U.S. PATENT DOCUMENTS

| | | | | |
|---|---|---|---|---|
| 9,528,670 | B2 | 12/2016 | Wu | |
| 10,520,148 | B2 * | 12/2019 | Li | F21S 10/046 |
| 2013/0050985 | A1 * | 2/2013 | Kwok | F21S 10/046 362/96 |
| 2014/0218903 | A1 * | 8/2014 | Sheng | F21S 10/046 362/190 |

(Continued)

FOREIGN PATENT DOCUMENTS

| | | | |
|---|---|---|---|
| CN | 203431703 | U | 2/2014 |
| CN | 103982865 | A | 8/2014 |

(Continued)

OTHER PUBLICATIONS

Internation Search Report of PCT/CN2018/000345, dated Dec. 28, 2018.

*Primary Examiner* — Alexander K Garlen
(74) *Attorney, Agent, or Firm* — Erson IP (Nelson IP)

(57) ABSTRACT

A candle flame piece flickering device includes a housing, a candle flame piece, a bracket, a bias coil and a circuit board, wherein a flame piece is arranged at an upper part of the candle flame piece; a counterweight column is arranged at a lower part of the candle flame piece; a permanent magnet is embedded in the bottom of the counterweight column; a support flange protruding upwards is arranged on a top surface of a vertical part of the bracket; a guide limiting column protruding downwards is arranged on a bottom surface of the vertical part; a horizontal part of the bracket is connected with an inner wall of the housing; and the support flange of the bracket is movably supported in a recessed part of the candle flame piece, so that the whole candle flame piece is movably suspended in the housing by the bracket.

10 Claims, 3 Drawing Sheets

(56) References Cited

U.S. PATENT DOCUMENTS

| | | | | |
|---|---|---|---|---|
| 2015/0233538 | A1* | 8/2015 | Sheng | F21S 10/046 362/190 |
| 2015/0308643 | A1* | 10/2015 | Huang | F21S 10/046 362/157 |
| 2016/0053954 | A1* | 2/2016 | Lai | F21V 23/00 362/393 |
| 2016/0258586 | A1 | 9/2016 | Patton | |
| 2017/0159901 | A1 | 6/2017 | Li | |
| 2017/0167677 | A1* | 6/2017 | Patton | F21S 10/046 |
| 2019/0338906 | A1* | 11/2019 | Ganz | F21S 9/02 |
| 2019/0350058 | A1* | 11/2019 | Wu | F21S 10/04 |

FOREIGN PATENT DOCUMENTS

| | | | | |
|---|---|---|---|---|
| CN | 205717016 | U | 11/2016 | |
| CN | 207750939 | U | 8/2018 | |
| DE | 202017107172 | U1 * | 1/2018 | F21S 6/001 |
| KR | 101164454 | B1 | 7/2012 | |

* cited by examiner

CANDLE FLAME PIECE FLICKERING DEVICE

CROSS-REFERENCE TO RELATED APPLICATIONS

This application is a continuation of International Patent Application No. PCT/CN2018/000345 with a filing date of Sep. 29, 2018, designating the United States, now pending, and further claims priority to Chinese Patent Application No. 201721330024.9 with a filing date of Sep. 30, 2017. The content of the aforementioned applications, including any intervening amendments thereto, are incorporated herein by reference.

TECHNICAL FIELD

The present invention relates to the technical field of electronic simulated candles, and particularly refers to a candle flame piece flickering device for driving a simulated candle flame piece to swing and flicker in the electronic simulated candle.

BACKGROUND OF THE PRESENT INVENTION

Candle flame piece flickering devices in the prior art, such as a candle flame piece flickering device for an electronic simulated, candle disclosed in Chinese patent CN103982865A (patent No. 201410184762.1), have problems that a candle flame, piece and a bracket structure of the device are high in cost during actual production because an injection mold has a complicated core pulling and demolding mechanism due to a structure of the candle flame piece. In addition, the device has problems of strong skill requirements, low efficiency and high cost, requires skilled manpower for assembly and does not adapt to automatic assembly by numerical control intelligent manipulators during assembly. Therefore, the prior art has problems and deficiencies of low efficiency and high cost.

SUMMARY OF PRESENT INVENTION

A technical problem to be solved by the present invention is to provide a candle flame piece flickering device with simple structure, simplified assembly process and low production cost with, respect to the above problems and deficiencies existing in the prior art.

A technical solution adopted by the present invention for solving the technical problem is as follows: the candle flame piece flickering device includes a housing as well as a candle flame piece, a bracket, a bias coil and a circuit board which, are arranged in the housing, wherein a torch-shaped flame piece is arranged at an upper part of the candle flame piece; a counterweight column for balancing the weight of the upper part is arranged at a lower part of the candle flame piece; a permanent magnet is embedded in the bottom of the counterweight column; a middle part of the candle flame piece is a middle neck; a recessed part is arranged at a center of a top end of the middle neck; the bracket is approximately T-shaped and includes a horizontal part located at a rear part of the bracket and a vertical part extending forwards from the middle part of the horizontal part; a support flange protruding upwards is arranged on a top surface of the vertical part; a guide limiting column protruding downwards is arranged on a bottom surface of the vertical part;

the horizontal part of the bracket is connected with an inner wall of the housing; and the support flange of the bracket is movably supported in the recessed part of the candle flame piece, so that the whole candle flame piece is movably suspended in the housing by the bracket.

In the above solution, the bias coil is eccentrically arranged relative to the permanent magnet; and the circuit board is electrically connected with the bias coil.

Preferably, a limiting block is extended to the outside from two sides of the vertical part of the bracket respectively; and a gap exists between the top surface of each limiting block and an edge of the recessed part in such a state that the recessed part of the candle flame piece is supported on the support flange of the bracket.

More preferably, the flame piece is recessed toward one side to form a recessed piece shape.

In the above solutions, a surface of the recessed part is a spherical surface, while the support flange is conical; and the top end of the support flange is spherical.

As an improvement, the counterweight column is tubular; and the permanent magnet is of a cylinder adaptive to the bottom of the counterweight column.

As an improvement, the middle neck is semi-cylindrical tubular; and the guide limiting column is cylindrical.

As a further improvement, the candle flame piece is a plastic member; the bracket is a blocky plastic member; the flame piece is located above the center of an upper end of the housing; and the middle neck and the counterweight column are located in an inner cavity of the upper part of the housing.

Compared with the prior art, the structure of the candle flame piece adopted by the device of the present invention can simplify an injection mold, reduce the cost, facilitate assembly, adapt to the technical solution of automatic assembly, and overcome problems and deficiencies of low efficiency and high cost in the prior art.

The candle flame piece flickering device provided by the present invention achieves purposes of simplifying the structure, reducing the cost and improving the assembly efficiency.

DETAILED DESCRIPTION OF PREFERRED EMBODIMENTS

Figure 1:
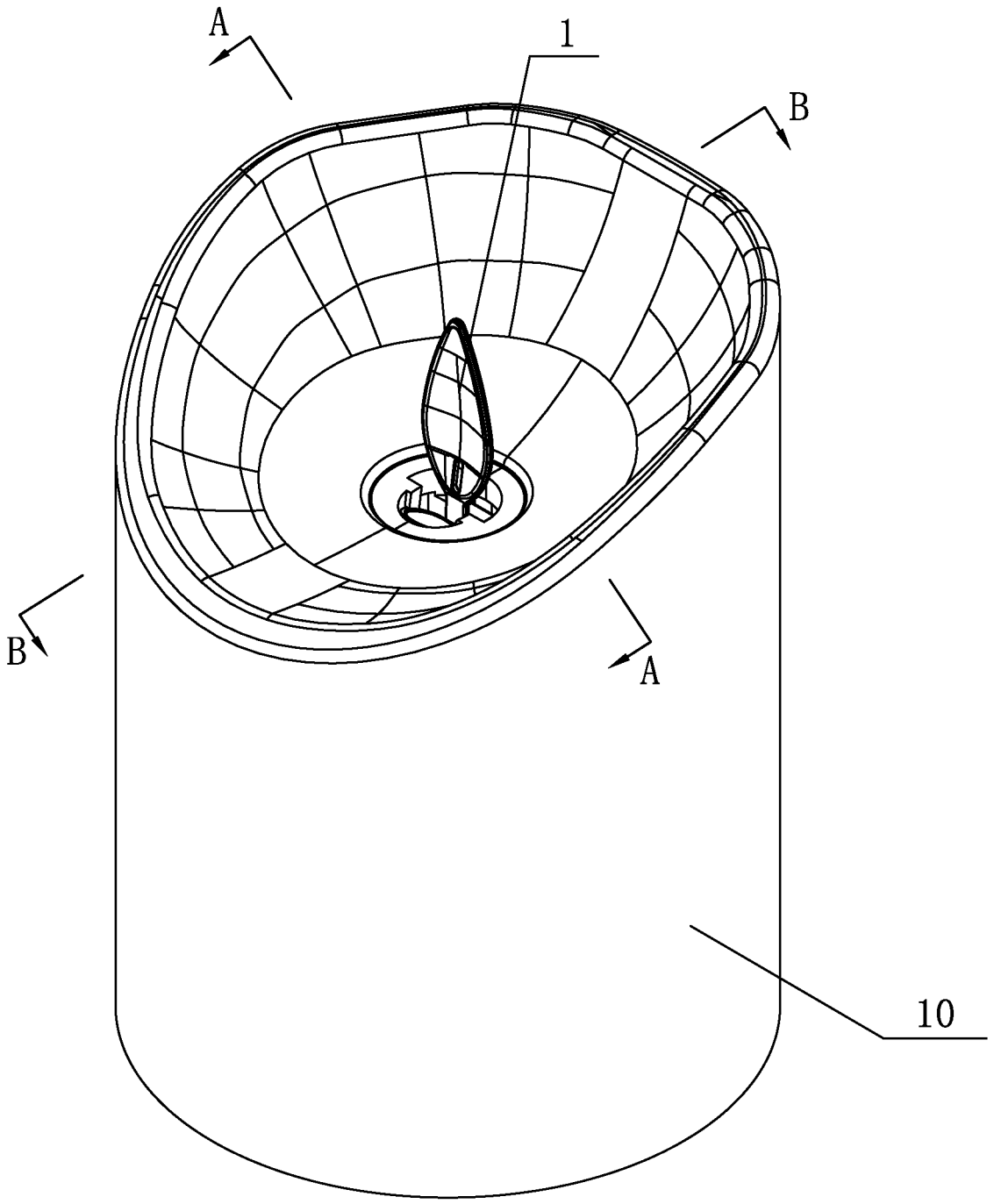
FIG. 1 is a structural schematic diagram in an embodiment of the present invention.

The present invention will be further described in detail below with reference to the accompanying drawings and embodiments.

As shown in FIGS. 1-7, as a preferred embodiment of the present invention, a candle flame piece flickering device includes a housing 10 as well as a candle flame piece 1, a bracket 2, a bias coil 3 and a circuit board 4 arranged, in the housing 10, wherein the candle flame piece 1 is a plastic member; a torch-shaped flame piece 11 is arranged at an upper part of the candle flame piece 1; the torch-shaped flame piece 11 is located above a center of an upper end of the housing 10; the flame piece 11 is recessed toward one side to form a recessed piece shape; a counterweight column 12 for balancing the weight of the upper part is arranged at a lower part of the candle flame piece 1; the counterweight column 12 is tubular; a permanent magnet 13 is embedded in the bottom of the counterweight column 12; the permanent magnet 13 is of a cylinder adaptive to the bottom of the counterweight column 12; a middle part of the candle flame piece 1 is a middle neck 14; the upper part and the lower part of the candle flame piece 1 are connected as a whole by the middle neck 14 at the middle part; a recessed part 15 is arranged at the center of a top end of the middle neck 14; and a surface of the recessed part 15 is a spherical surface. In the present embodiment, the middle neck 14 and the counterweight column 12 are located in an inner cavity of the upper part of the housing 10.

The bracket 2 is a blocky plastic member, is approximately T-shaped and includes a horizontal part located at a rear part of the bracket 2 and a vertical part extending forwards from the middle part of the horizontal part; the horizontal part is connected with an inner wall of the housing 10; a support flange 21 protruding upwards is arranged on a top surface of the vertical part; the support flange 21 is movably supported in the recessed part 15 of the candle flame piece 1, so that the whole candle flame piece 1 is movably suspended in the housing 10 by the bracket 2. In the present embodiment, the support flange 21 is conical; and the top end of the support flange 21 is spherical. Thus, the top end of the support flange 21 is propped in the recessed part 15 with a spherical surface; and swinging action of the support flange 21 relative to the top end of the middle neck 14 is smoother and more natural, so that a swinging effect of the candle flame is more realistic. A guide limiting column 22 protruding downwards is further arranged on a bottom surface of the vertical part.

A limiting block 23 is extended to the outside from both sides of the vertical part of the bracket 2 respectively; and a gap exists between the top surface of each limiting block 23 and an edge 15*a* of the recessed part 15 in such a state that the recessed part 15 of the candle flame piece 1 is supported on the support flange 21 of the bracket 2. The gap provides a movable space for the swinging of the candle flame piece 1 relative to the bracket 2; the limiting blocks 23 on both sides of the bracket 2 will touch the edge 15*a* of the recessed part 15 in a process of swinging the candle flame piece 1 relative to the bracket 2; and the candle flame piece 1 swings by a certain angle relative to a vertical center line (i.e., the candle flame piece 1 is located on the vertical center line in a reset state) of the bracket 2 at this moment. The angle is 35 degrees in the present embodiment. See FIGS. 4-7 for details.

Figure 2:
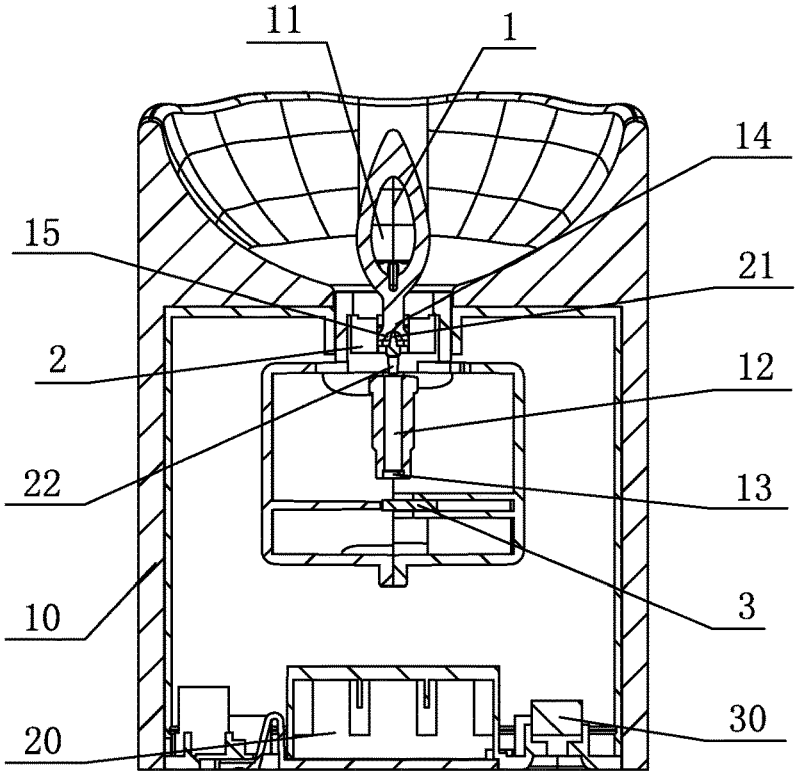
FIG. 2 is a section view in an A-A direction in FIG. 1.
Figure 3:
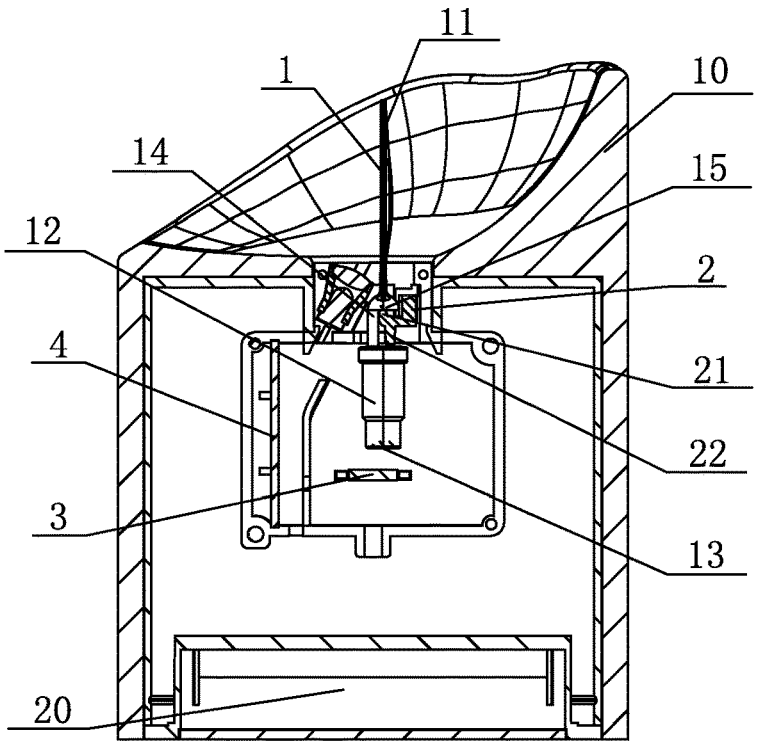
FIG. 3 is a section view in a B-B direction in FIG. 1.
Figure 4:
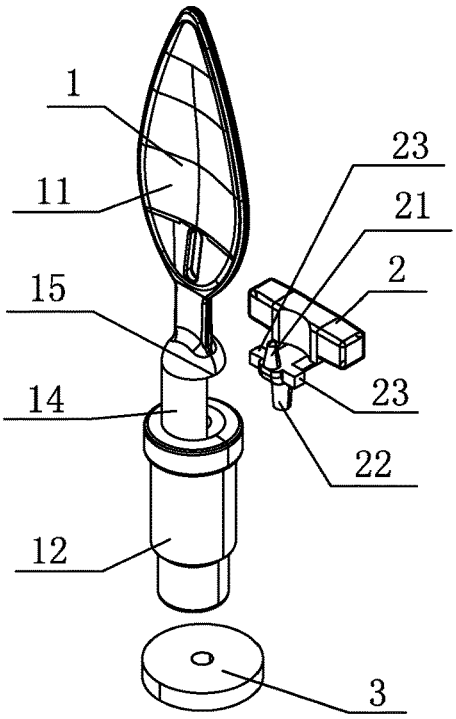
FIG. 4 is a stereoscopic exploded view of, a candle flame piece, a bracket and a bias coil in an embodiment of the present invention.
Figure 5:
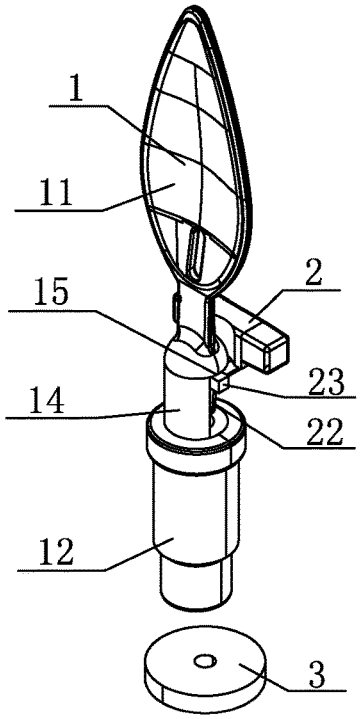
FIG. 5 is a schematic diagram of an assembly structure of a candle flame piece, a bracket and a bias coil in an embodiment of the present invention.
Figure 6:
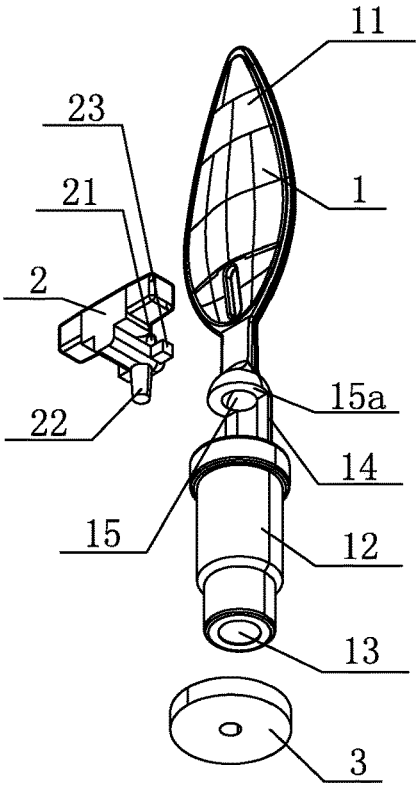
FIG. 6 is a stereoscopic exploded view of a candle flame piece, a bracket and a bias coil from another perspective in, an embodiment of the present invention.
Figure 7:
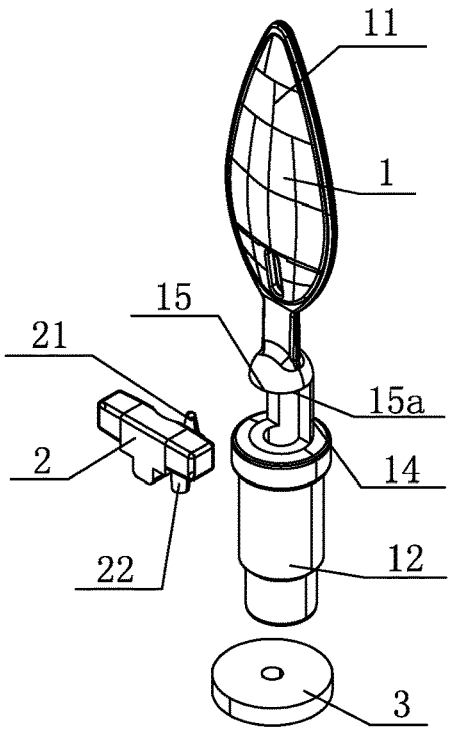
FIG. 7 is a stereoscopic exploded view of, a candle flame piece, a bracket and a bias coil from a still another perspective in an embodiment of the present invention.

As shown in FIGS. 2 and 3, the bias coil 3 is eccentrically arranged relative to the permanent magnet 13; and the circuit board 4 is electrically connected with the bias coil 3. The candle flame piece flickering device according to the present embodiment further includes a battery compartment 20 and a switch 30 arranged at the bottom of the housing; and the circuit board 4 is electrically connected with the battery compartment 20 by the switch 30.

Working Principles and Beneficial Effects.

During application, batteries are loaded into the battery compartment 20. During operation, the circuit board 4 converts direct current (DC) supplied by the batteries into spaced DC square wave pulses for output; the bias coil 3 is excited to generate spaced pulse magnetic fields; and pulsating bias magnetic fields drives the candle flame piece 1 to tilt intermittently by the permanent magnet 13. Due to movable support of the support flange 21 to the recessed part 15, the candle flame piece 1 generates intermittent and balanced swinging motion, so that the flame piece 11 of the candle flame piece 1 seems to be, flickering candle flame under irradiation of an LED lamp.

The cylindrical stepped tubular structure of the counterweight column 12 of the candle flame piece 1 can simplify a core pulling and demolding mechanism of the injection mold, thereby reducing production and manufacturing costs. In addition, the structure that the support flange 21 is arranged at the bracket 2, and the recessed part 15 is arranged at the candle flame piece 1 to facilitate assembly and adapt to automatic assembly by, numerical control intelligent manipulators, thereby avoiding a disadvantage of requiring skilled manpower for assembly, improving the production efficiency and reducing the comprehensive cost.

The device is simple in structure, low in cost and convenient to assemble, so that the candle flame piece flickering device for a simulated candle simplifies the structure, reduces the cost, improves the assembly efficiency, adapts to automatic assembly by the numerical control intelligent manipulators, and meets requirements of automatic mass production.

I claim:

1. A candle flame piece flickering device, comprising a housing and a candle flame piece, a bracket, a bias coil and a circuit board arranged in the housing;

wherein a torch shaped flame piece is arranged at an upper part of the candle flame piece; a counterweight column for balancing the weight of the upper part is arranged at a lower part of the candle flame piece; a permanent magnet is embedded in the bottom of the counterweight column; a middle neck is located between the torch shaped flame piece and the counterweight column; a recessed part is arranged at a center of a top end of the middle neck;

the bracket is approximately T-shaped and comprises a horizontal part located at a rear part of the bracket and a vertical part extending forwards from the middle part of the horizontal part; a support flange protruding upwards is arranged on a top surface of the vertical part; a guide limiting column protruding downwards is arranged on a bottom surface of the vertical part;

the horizontal part of the bracket is connected with an inner wall of the housing and the support flange of the bracket is movably inserted into the recessed part of the candle flame piece, so that the whole candle flame piece is movably suspended in the housing by the bracket;

wherein the bias coil is eccentrically arranged relative to the permanent magnet, and the circuit board electrically connected with the bias coil.

2. The candle flame piece flickering device of claim 1, wherein a limiting block is extended to the outside from both sides of the vertical part of the bracket respectively; and a gap exists between the top surface of each limiting block and an edge of the recessed part in such a state that the recessed part of the candle flame piece is supported on the support flange of the bracket.

3. The candle flame piece flickering device of claim 1, wherein the flame piece is recessed toward one side to form a recessed piece shape.

4. The candle flame piece flickering device of claim 1, wherein a surface of the recessed part is an inward spherical surface, while the support flange is conical and the top end of the support flange comprises an outward spherical surface matching with the inward spherical surface, so that the top end of support flange is capable of swinging smoothly within the recessed part.

5. The candle flame piece flickering device of claim 1, wherein the counterweight column is tubular; and the permanent magnet is of a cylinder adaptive to the bottom of the counterweight column.

6. The candle flame piece flickering device of claim 1, wherein the middle neck is semi-cylindrical tubular; and the guide limiting column is cylindrical.

7. The candle flame piece flickering device of claim 1, wherein the candle flame piece is a plastic member; the bracket is a blocky plastic member; the flame piece is located above the center of an upper end of the housing and the middle neck and the counterweight column are located in an inner cavity of the upper part of the housing.

8. The candle flame piece flickering device of claim 2, wherein a surface of the recessed part is a spherical surface, while the support flange is conical; and the top end of the support flange is spherical.

9. The candle flame piece flickering device of claim 2, wherein a surface of the recessed part is a spherical surface, while the support flange is conical; and the top end of the support flange is spherical.

10. The candle flame piece flickering device of claim 3, wherein a surface of the recessed part is a spherical surface, while the support flange is conical; and the top end of the support flange is spherical.

* * * * *